United States Patent [19]

Youssef

[11] Patent Number: 5,067,877

[45] Date of Patent: Nov. 26, 1991

[54] FAN BLADE AXIAL RETENTION DEVICE

[75] Inventor: Nashed A. Youssef, Mississauga, Canada

[73] Assignee: United Technologies Corporation, Hartford, Conn.

[21] Appl. No.: 580,709

[22] Filed: Sep. 11, 1990

[51] Int. Cl.[5] ..... F01D 5/32

[52] U.S. Cl. ..... 416/220 R

[58] Field of Search ..... 416/219 R, 220 R, 248

[56] References Cited

U.S. PATENT DOCUMENTS

| | | | |
|---|---|---|---|
| 3,734,646 | 5/1973 | Perkins | 416/219 R |
| 4,470,756 | 9/1984 | Rigo et al. | 416/219 R |

FOREIGN PATENT DOCUMENTS

| | | | |
|---|---|---|---|
| 77236 | 4/1983 | European Pat. Off. | 416/219 R |
| 226202 | 12/1984 | Japan | 416/219 R |
| 23802 | 2/1986 | Japan | 416/220 R |
| 29703 | 2/1987 | Japan | 416/220 R |
| 155168 | 2/1954 | United Kingdom | 416/220 |
| 798613 | 7/1958 | United Kingdom | 416/219 R |

*Primary Examiner*—John T. Kwon

*Attorney, Agent, or Firm*—Troxell K. Snyder

[57] ABSTRACT

A fan blade retention device includes a retaining flange (18) located aft of the blade fixing element (7). The flange (18) abuts an outwardly facing circumferential groove (13) located between the flange (18) and the female half of the blade fixing element (10). The groove (13) is large enough to allow the blade fixing element (7) machining tool to be removed. The fan blade (28) includes an extension (21) of the blade root (11) on the aft side of the blade (28). When the blade root (11) is fully received within the female half of the blade fixing element (10), the blade extension (21) spans the width (20) of the groove and contacts the flange (18), thereby preventing the fan blade (28) from traveling aft.

3 Claims, 2 Drawing Sheets

FIG. 4
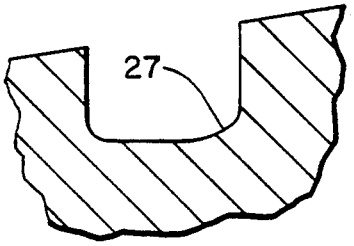
FIG. 5
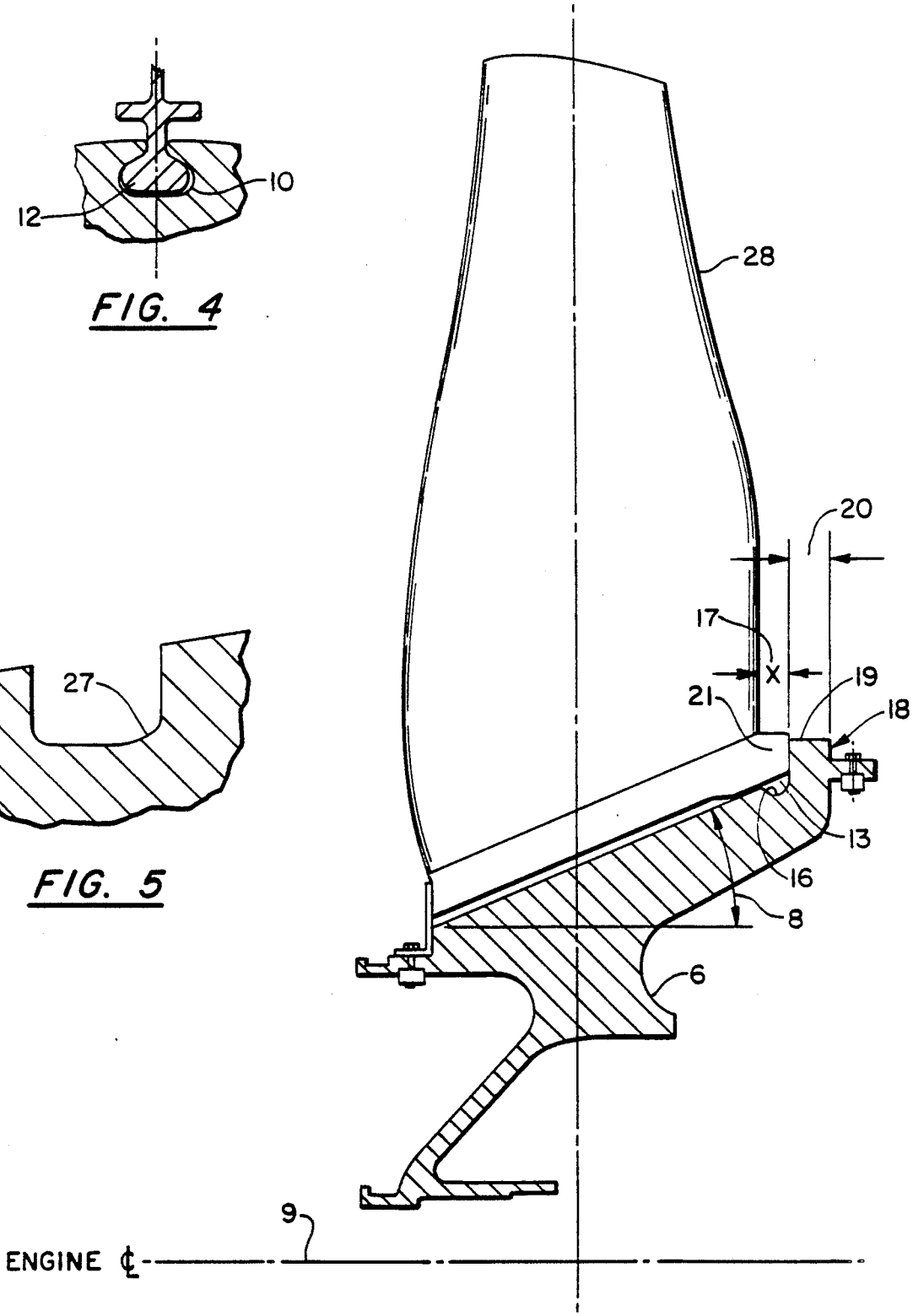
FIG. 3

FAN BLADE AXIAL RETENTION DEVICE

TECHNICAL FIELD

This invention relates to fan blade axial retention devices and more particularly to retention devices which apply to fan blade fixing joints oriented at an angle to the centerline of the engine.

BACKGROUND ART

In turbofan engines, fan blade fixing commonly takes the form of a dovetail joint. In conventional configurations, the base of the joint lies in a plane aligned parallel to the centerline of the engine. Because of highly sloped gas path characteristics, engines with axially aligned blade fixing require a platform on each fan blade to maintain the gas path profile established by the nose cone. The result is a significant distance between the hub outer diameter and the aft blade platform. This distance, combined with both the mass of the blade root spanning that distance and the mass of the blade platform, causes an additional load on the hub due to centrifugal forces which act on the blade as the hub assembly rotates. To compensate for the additional load, it is necessary to make the blade root "stockier" than the blade, which compounds the problem. These additional loads result in undesired stress within the hub.

A fan blade fixing configuration at an inclined angle relative to the engine centerline reduces the distance from the aft blade platform to the outer hub diameter. As a result, blade mass is reduced as well as the centrifugal force associated with the blade mass. There is a tradeoff, however. In conventional configurations with the blade fixing axially aligned, the centrifugal loading on the fan blade is almost entirely handled by the dovetail joint. This is possible because the centrifugal load appears solely as a radial force acting up through the fan blade. With the blade fixing at an incline, however, the centrifugal force vector resolves into both a normal force and a parallel force and it becomes necessary to secure the blade axially as well as radially in the hub.

Existing designs include securing the blade axially by a "hook" formed on the forward edge of the blade root. The hook contacts the hub, or an internal locking ring, thereby preventing the blade from traveling up the blade fixing incline. A serious disadvantage of this design is the tensile and bending stresses inherent in the hook configuration. To withstand these stresses, the mass of the hook must be substantial, especially for larger engines. Gains in the reduction of blade mass with the inclined configuration are lost as the hook is necessarily designed larger and larger with increasing engine size. Moreover, at some juncture hooks are no longer feasible from a physical constraint standpoint.

DISCLOSURE OF INVENTION

Objects of the present invention include provision of an axial retention device for a turbofan blade fixed to the fan hub at an incline relative to the engine centerline.

According to one aspect of the present invention, a fan hub is provided with an integral retaining flange located aft of the blade fixing means. The flange abuts an outwardly facing groove located between the flange and the female half of the blade fixing means. The female half may be, for instance, a dovetail or fir tree channel machined into the hub. The purpose of the groove is to allow the machining tool to be removed during the cutting process of the channel. Groove dimensions are dictated by the space necessary to remove the tool. The flange, which checks the blade root from traveling further aft, comprises a sufficient thickness to sustain the aftward force vector imposed on the blade parallel to the blade fixing channel. For example, the blade fixing means may consist of a dovetail joint comprising a channel machined within the hub exterior and a male dovetail formed on the base of the blade root. When the blade root is inserted into the channel, the root travels through the channel and across the groove, contacting the ring.

Advantages of this design include it being a simple retaining device which both minimizes the number of additional parts and economizes blade and hub production cost. The blade root simply slides into the dovetail channel until it contacts the flange. The retaining flange bears the entire parallel load of the blade root. Because the load transfers directly from the blade root to the flange, no additional hardware such as a collar or retaining ring is necessary to fix the blade in the hub. Nor is the blade required to include stress inducing structures such as a hook on the front side of the blade. Consequently, the blade can be manufactured and replaced much more economically.

According to another aspect of the present invention, the fan blade root includes an extension on the aft side of the blade root. When the blade is in position, the blade root extension spans a defined distance and contacts the flange. The distance necessary to remove the dovetail channel machining tool determines the minimum distance the blade root extension must span.

The advantage of the blade root extension is that only the distance necessary to span the groove must be held to tight tolerances. In addition, the extension is much less massive than other retaining configurations because the parallel load transmitted through the extension to the flange produces only compressive stresses within the extension. Consequently, both manufacturing costs and blade mass can be reduced.

BRIEF DESCRIPTION OF THE DRAWINGS

FIG. 3 is a sectional view of the assembled fan blade and hub.

FIG. 4 shows an enlarged sectional view of the dovetail joint shown in FIG. 3.

FIG. 5 is an enlargement of the aft corner fillet showing the alternative multi-radius fillet.

BEST MODE FOR CARRYING OUT THE INVENTION

Figure 2:
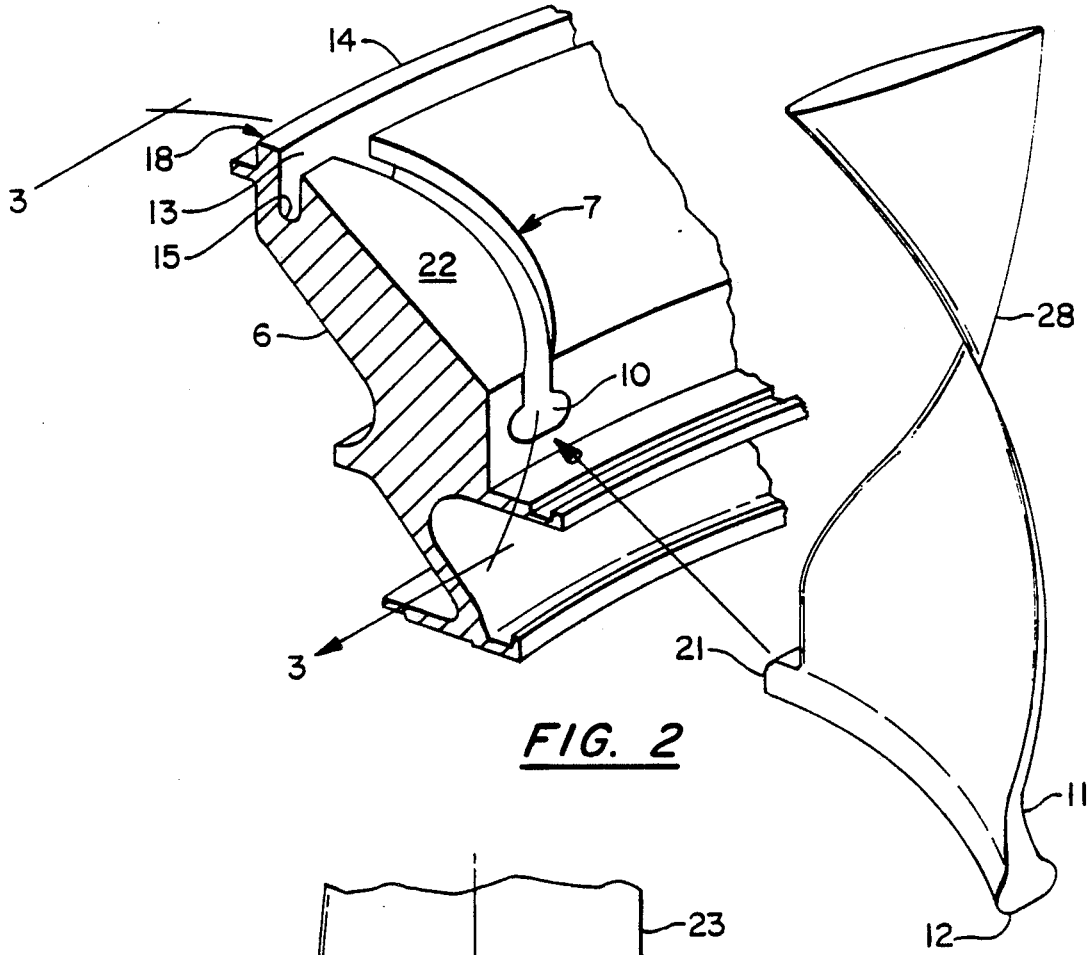
FIG. 2 is a perspective view of a hub with the blade positioned to slide into the curved dovetail.
Figure 1:
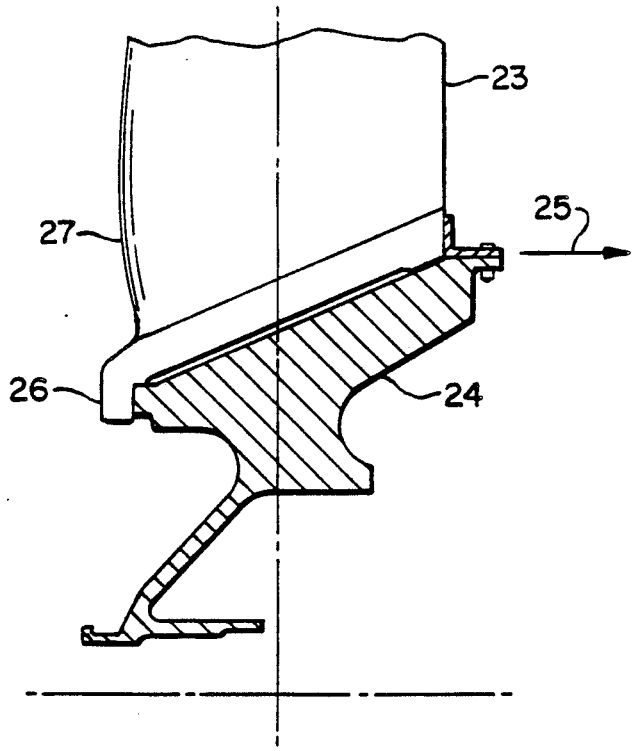
FIG. 1 PRIOR ART
FIG. 1 is a cross-sectional view of a hub and blade assembly showing the prior art "forward edge hook" method of retaining the blade axially.

Referring to FIG. 1, prior art teaches that a fan blade 23 can be attached to a rotating hub 24 and restrained from traveling in the aft direction 25 by a hook 26 integrally formed of the forward edge 27 of the blade 23.

Now referring to FIG. 2, FIG. 3, FIG. 4, and FIG. 5, according to the present invention a fan blade 28 is attached to the rotating hub 6 of a turbofan engine. The fan blade 28 is attached to the hub 6 by a curved or linear dovetail joint 7 which is oriented at an inclined angle 8 relative to the engine centerline 9. The dovetail channel 10 is cut in the hub 6 and the base of the blade root 11 is formed into a complimentary male dovetail 12.

A circumferential groove 13 is located in the exterior surface 22 of the hub 6 adjacent to the dovetail channel 10 on the aft side 14 of the hub 6. The groove 13 is machined, in this example, at least as deep as the channel 10 and contains fillets 15 on the inside corners. Employed to reduce stress, the fillets 15 may be cut as a single radius 16 or as a combination of radii 27 to optimize stress reduction. The width 17 of the groove 13 is determined by the space necessary to remove the machining tool (not shown) used to cut the dovetail channel 10.

Aft and adjacent to the groove 13 is a retaining flange 18 integrally formed of the hub 6. The outer diameter 19 of the flange 18 is such that when the blade root 12 is pushed through the dovetail channel 10 and the blade root extension 21 crosses the groove 13, the extension 21 contacts the flange 18 and is prevented from moving further aft. The flange 18 comprises a thickness 20 sufficient to sustain the parallel load resulting from centrifugal force on the blade 28 during operation. Both the thickness 20 and the aft location of the flange 18 combine to withstand higher loadings and the consequent stress, than is permissible with the known method of a hook 26 integral to the forward edge 27 of the blade 23.

The fan blade 28 contacts the flange 18 through an extension 21 of the blade root 11 on the aft side 14 of the blade 28. The extension 21 spans the width 20 of the groove 13. Because the blade 28, in this example, is not extended along with the blade root 11, and no other more massive attachment means is included, such as the prior art forward hook (FIG. 1), blade mass is minimized. Blade mass reduction and consequent hub load reduction is a primary goal of the present invention.

What is claimed is:

1. A device for retaining a blade for an axial fan having a dovetail root and received within a corresponding dovetail channel in an annular hub, wherein the dovetail channel further slopes radially outward with respect to the fan axis, comprising:

a retaining flange extending radially outward relative to the centerline of the hub, located aft of the dovetail channel and integrally formed of the hub, wherein said flange has an outer diameter large enough to check the blade root from traveling aftward nd a sufficient thickness to sustain axial loads transmitted through the blades;

wherein the fan blade includes an extension of the root end extending out in the aftward direction, contacting said flange, and wherein the hub includes a circumferential groove in the exterior surface of the hub, located between both said flange and the dovetail channel, wherein said groove width is sufficient to permit removal of a channel cutting machine tool, and wherein said groove depth is at least as great of the depth of the adjacent end of the dovetail channel.

2. The device for retaining a blade for an axial fan according to claim 1, wherein said groove further comprises fillets on each inside corner, and each fillet includes a single radius.

3. The device for retaining a blade for an axial fan according to claim 1, wherein said groove further comprises fillets on each inside corner, and wherein one of the fillets further comprises a multi-radius fillet.

* * * * *

UNITED STATES PATENT AND TRADEMARK OFFICE

CERTIFICATE OF CORRECTION

PATENT NO. : 5,067,877

DATED : November 26, 1991

INVENTOR(S) : Nashed A. Youssef

It is certified that error appears in the above-identified patent and that said Letters Patent is hereby corrected as shown below:

Claim 1, Column 4, line 5, "and" should read --end--

Claim 1, Column 4, line 14, "nd" should read --and--

Signed and Sealed this

Thirtieth Day of March, 1993

*Attest:*

STEPHEN G. KUNIN

*Attesting Officer*

*Acting Commissioner of Patents and Trademarks*